US009117622B2

(12) United States Patent
Gendreau et al.

(10) Patent No.: US 9,117,622 B2
(45) Date of Patent: Aug. 25, 2015

(54) MINIATURIZED HIGH-SPEED MODULATED X-RAY SOURCE

(75) Inventors: Keith C. Gendreau, Greenbelt, MD (US); Zaven Arzoumanian, Greenbelt, MD (US); Steven J. Kenyon, Hanover, MD (US); Nick Salvatore Spartana, Baltimore, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 214 days.

(21) Appl. No.: 13/570,122

(22) Filed: Aug. 8, 2012

(65) Prior Publication Data

US 2014/0044239 A1 Feb. 13, 2014

(51) Int. Cl.

| | |
|---|---|
| ***H01J 35/00*** | (2006.01) |
| ***H01J 35/06*** | (2006.01) |
| ***H05G 1/70*** | (2006.01) |

(52) U.S. Cl.

CPC ..... *H01J 35/065* (2013.01); *H01J 35/06* (2013.01); *H05G 1/70* (2013.01)

(58) Field of Classification Search

CPC ..... H05G 1/34; H05G 2/00; H01J 35/06; H01J 35/065; H01J 35/14

USPC ..... 378/119, 121, 123, 136

See application file for complete search history.

(56) References Cited

U.S. PATENT DOCUMENTS

| | | | | |
|---|---|---|---|---|
| 8,837,678 | B2 * | 9/2014 | Turqueti et al. | 378/124 |
| 2012/0027181 | A1 * | 2/2012 | Takai et al. | 378/121 |

OTHER PUBLICATIONS

T. Kisa et al., Electron emission from LiNbO 3 crystal excited by ultraviolet laser, JVSTB, Journal of Vacuum Science & Technology B, Mar. 29, 2010.

C.P. De Vries et al., Filters and calibration sources for the Soft X-ray Spectrometer (SXS) instrument on ASTRO-H, Space Telescopes and Instrumentation 2010: Ultraviolet to Gamma Ray, 2010, Proc. of SPIE vol. 7732, 773213.

* cited by examiner

*Primary Examiner* — Courtney Thomas

(57) ABSTRACT

A miniaturized high-speed modulated X-ray source (MXS) device and a method for rapidly and arbitrarily varying with time the output X-ray photon intensities and energies. The MXS device includes an ultraviolet emitter that emits ultraviolet light, a photocathode operably coupled to the ultraviolet light-emitting diode that emits electrons, an electron multiplier operably coupled to the photocathode that multiplies incident electrons, and an anode operably coupled to the electron multiplier that is configured to produce X-rays. The method for modulating MXS includes modulating an intensity of an ultraviolet emitter to emit ultraviolet light, generating electrons in response to the ultraviolet light, multiplying the electrons to become more electrons, and producing X-rays by an anode that includes a target material configured to produce X-rays in response to impact of the more electrons.

21 Claims, 2 Drawing Sheets

MINIATURIZED HIGH-SPEED MODULATED X-RAY SOURCE

INVENTION BY GOVERNMENT EMPLOYEE(S) ONLY

The invention described herein was made by an employee of the United States Government, and may be manufactured and used by or for the Government for governmental purposes without the payment of any royalties thereon or therefor.

CLAIM TO PRIORITY

This application claims priority to Provisional Application No. 61/590,993, titled "Miniaturized High Speed Modulated X-Ray Source," filed on Jan. 26, 2012, the contents of which are herein incorporated by reference.

FIELD

The invention relates generally to sources of X-ray radiation; and more particularly, to a miniaturized high-speed modulated X-ray source (MXS) device and a method for rapidly and arbitrarily varying with time the output X-ray photon intensities and energies.

BACKGROUND

The wavelength of light is related to its energy: the shorter the wavelength, the higher the frequency, and the higher the energy. X-ray radiation generally corresponds to wavelengths in the range 0.01 to 10 nanometers and energies in the range of 120 electron-volts (eV) to 120 keV.

X-rays are valued in medical imaging for their ability to penetrate soft tissue, and in materials science applications because they reveal physical (e.g., crystal) properties through diffraction and chemical composition through characteristic spectral (fluorescence) lines. X-ray wavelength or energy is typically adjusted to suit particular applications (e.g., a particular medical imaging technique on a particular type of tissue), but additional control capability is often desirable. For example, X-ray radiation used in medical imaging is classified as a carcinogen by both the World Health Organization and the U.S. government. Deleterious physical effects on tissue are proportional to the X-ray energy and exposure time. High-precision dose control through time-variation of the X-ray emitter is thus highly desirable to realize diagnostic or therapeutic outcomes while minimizing unintended side effects.

A calibrated X-ray detector is needed to measure the energies of X-rays; such spectroscopy is relevant to materials science and space (e.g., X-ray astronomy) applications. Most present methods of in-flight X-ray detector calibration use radioactive sources to generate X-rays of known energy. However, this calibration method greatly reduces the sensitivity of the X-ray detector because X-rays constantly produced by the radioactive source become a source of background "noise" that hinders the detection of cosmic X-rays. What is needed is a modulated X-ray source (MXS) that allows an X-ray detector to both remain properly calibrated and retain its sensitivity by producing X-rays only at predetermined intervals and at a controllable rate.

Prior state-of-the-art MXS systems could generally vary their output intensity only on timescales of seconds in the ease of hot filament X-ray sources. There are also femtosecond X-ray pulsers, but they cannot produce output X-ray flux with arbitrary waveforms because the lasers that drive those sources have minimum pulse recovery and recycling times, and cannot arbitrarily and continuously vary the output intensity. Moreover, the output X-ray flux of most prior MXS technologies has been too small to be useful for many applications, while their size and input power needs have been too large to allow portability, again limiting their potential applications. Meanwhile, the cost to manufacture them is high.

Photoelectric X-ray sources have been proposed in the past for limited applications typically not involving high flux, rugged portability, or the need for arbitrary intensity variation. Previous photoelectrically driven X-ray sources typically use high-efficiency photocathodes, which are extremely unstable and cease to function after exposure to minimal quantities of oxygen. In addition, these high-efficiency photocathodes have considerable "dark current" (electron emission even in the absence of stimulating light), which would produce unwanted X-rays during "off" times.

Accordingly, it would be desirable to provide an X-ray source device that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to an X-ray source device. In one embodiment, the X-ray source device includes an ultraviolet emitter that emits ultraviolet light, a photocathode operably coupled to the ultraviolet light-emitting diode that emits electrons, an electron multiplier operably coupled to the photocathode that multiplies incident electrons, and an anode operably coupled to the electron multiplier that is configured to produce X-rays.

Another aspect of the exemplary embodiments related to a method for modulating an X-ray source. In one embodiment, the method includes modulating an intensity of an ultraviolet emitter to emit ultraviolet light, generating electrons in response to the ultraviolet light, multiplying the electrons to become more electrons, and producing X-rays by an anode that includes a target material configured to produce X-rays in response to impact of the more electrons.

These and other aspects and advantages of the exemplary embodiments will become apparent from the following detailed description considered in conjunction with the accompanying drawings. It is to be understood, however. that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

Figure 1:
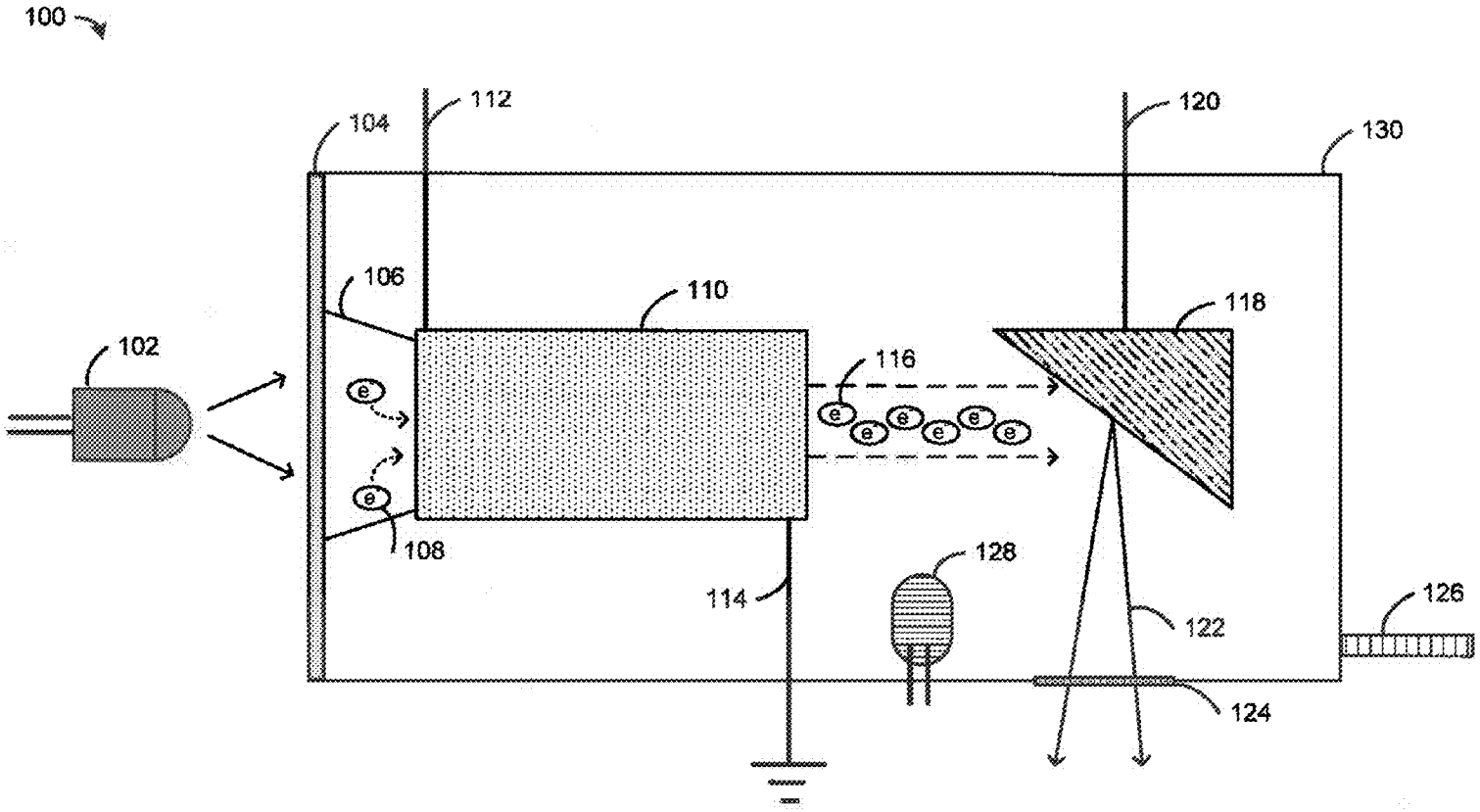
FIG. 1 is a schematic diagram generally representing an exemplary architecture of system components of a MXS device incorporating aspects of the present disclosure.

The present disclosure is generally directed towards a miniaturized high-speed modulated X-ray source (MXS) device and a method for modulating their X-ray output. The miniature, low-power, light-weight and rugged X-ray source can be arbitrarily modulated in intensity from completely off to full intensity on nanosecond timescales or less, for X-ray energies from a few hundred eV to at least 100 keV through the choice of one or more electron target materials. As will be understood, the various diagrams, flow charts and scenarios described herein are only examples, and there are many other scenarios to which the present disclosure will apply.

In one embodiment, the MXS uses ultraviolet light to generate a photoelectric current that is amplified by a large factor. The resulting electrons are accelerated onto a target held at high voltage. The impact and sudden deceleration of the electrons in the target emits X-rays. Specifically, ultraviolet light emitted by an ultraviolet light-emitting diode (UV LED) shines through a window onto a photocathode where the energetic UV photons stimulate electron emission from the photocathode by means of the photoelectric effect. Electrons emitted in this manner may be referred to as photoelectrons. An electron multiplication system (such as a commercially available electron multiplier component in one embodiment, or a commercially available micro-channel plate in another) operably coupled to the photocathode further multiplies these electrons through a process called secondary emission. Multiplied electrons are then accelerated towards an anode and collided into an electron target on the anode. Such collisions cause X-rays characteristic of the electron target to be emitted.

Modulating the intensity of the UV LED modulates the number of photoelectrons emitted by the photocathode and thus, ultimately, the intensity of X-rays produced. This embodiment makes no use of filaments and produces X-ray output intensity from zero ("off") to maximum intensity corresponding to the modulation of UV LED from zero to full intensity, on nanosecond timescales or less. Moreover, this embodiment is smaller by an order of magnitude and about 1/100th the cost to produce compared to traditional MXS systems.

Advantageously, many embodiments according to the present disclosure can be used as the core of many new devices to provide a practical arbitrarily time-variable source of X-rays. The advanced features of high-speed switching capability, high intensity output, miniature size, and light weight make possible a wide range of new technologies in many fields including X-ray based communication, portable and/or time-resolved X-ray diffraction, novel X-ray fluorescence instruments, precise low-dose medical X-rays, to name just a few.

In the medical field, an embodiment of the present disclosure can be used for precise dose control in X-ray imaging as well as X-ray treatment with a degree of control unparalleled by any other X-ray source. In addition, another embodiment of the present disclosure provides for high-speed switching of output X-ray energy, thus enabling rapid high-contrast imaging using inexpensive X-ray detection technologies with poor-to-moderate energy resolution (such as proportional counters).

In the field of communication, an embodiment of the present disclosure can become the core component enabling new X-ray communication (XCOM) systems that have a number of novel usages. At higher energies, XCOM can provide communication links with hypersonic vehicles that would normally be isolated by an RF blackout associated with the superheated air around the vehicle. XCOM also has the potential to provide high data rates at low power consumption over vast distances in space. For future space missions, X-ray communications can be much more power-efficient, in terms of transmitted data rate vs. required transmitter power, than conventional radio or even laser communication systems because XCOM beams in space (e.g., between geosynchronous and low Earth orbits) can be much tighter than even laser communication beams.

In the field of security, particularly for the defense industry and intelligence communities, an embodiment of the present disclosure can provide secure communication by the fact that, when coupled with X-ray diffraction limited optics, XCOM sidelobes would be vanishingly small, eliminating the possibility of undetected eavesdropping. Yet another embodiment of the present disclosure can enable material inspection and chemical analysis systems by working synchronously with a low energy-resolution, large area X-ray detector to produce high contrast images by flashing X-rays alternatingly with energies just above and just below a characteristic absorption edge for a chemical element of interest, for example using multiple synchronized MXS devices configured to produce different output X-ray energies.

For the purpose of calibration, the present disclosure can be exploited to characterize more fully and more efficiently than many types of X-ray detectors and instruments already in use in medical, industrial, and scientific (laboratory or space astrophysics) applications, by minimizing persistent background associated with traditional X-ray sources and thus increasing efficiency and sensitivity. X-ray detector gain (i.e., energy scaling), quantum efficiency, and especially timing properties can all be ideally calibrated with aspects of the disclosed embodiments.

Turning to FIG. 1 of the drawings, there is shown a schematic diagram generally representing an exemplary architecture of system components of a MXS device 100 incorporating aspects of the present disclosure. The basic operation of an MXS device is to accelerate electrons into a target material held at a high potential. When the electrons collide into the target, X-rays are produced with a spectrum that is a function of the kinetic energy of the electrons and the target material. In this embodiment, the electrons start off as optically-driven photoelectrons rather than electrons from a hot filament. The modulation of the X-rays is then tied to the modulation of the light.

In this embodiment, ultraviolet light is used to generate photoelectrons that are accelerated into a high-voltage target, which emits X-rays. Specifically, ultraviolet light emitted by an ultraviolet light-emitting diode (UV LED) 102 shines through a UV-transparent window 104 onto a photocathode 106 where the UV photons cause electrons 108 to be emitted from the photocathode by means of the photoelectric effect. Electrons emitted in this manner may be referred to as photoelectrons. A high-gain electron multiplier 110 operably coupled to the photocathode 106 further multiplies these electrons through a process called secondary emission. Multiplied electrons 116 are then accelerated towards an anode 118 and collided into an electron target on the anode. Such collisions produce X-rays 122 which radiate through an X-ray-transparent window 124.

The electron multiplier 110 may be provided with a bias voltage through a multiplier high voltage (HV) feedthrough 112 and a return path 114 to ground. The bias voltage determines the multiplier's amplification factor; it is typically negative and at the multiplier's input end, with −3 kV providing a 100,000,000-fold gain ($10^8$) in a typical embodiment. The anode 118 is powered through a target HV feedthrough 120 with sufficient positive high voltage to produce X-rays of the desired maximum energy; for example, +4 kV applied to feedthrough 120 will produce maximum X-ray output energies of 2-3 keV, and +10 kV applied to feedthrough 120 will produce maximum X-ray output energies of 8-9 keV. The anode 118 includes a target material, such as tungsten, titanium, copper, or gold. The multiplied electrons 116, after colliding with the target material, will accelerate other electrons, ions and nuclei within the target material. A portion of the energy generated is emitted as X-rays 122.

A vacuum tube 130 is used to house the photocathode 106, the electron multiplier 110, and the anode 118 so that the multiplied electrons 116 in a vacuum may be collected by the anode 118, thus establishing a flow of electrical current, known as the beam, through the vacuum tube 130. A pump-out tube 126 is optionally coupled to the vacuum tube 130. Once a vacuum has been established inside the vacuum tube 130 by pumping through the pump-out tube 126, the pump-out tube 126 may be pinched off to seal the vacuum tube 130. A getter 128 is also optionally coupled to the evacuated tube 130 which can be configured to maintain vacuum inside the vacuum tube 130.

In this embodiment, it is advantageous to use the UV LED 102 to drive the X-ray source. In general, photoelectric efficiency increases as the wavelength of the stimulating optical light decreases. UV light from common 255-350 nm LEDs may stimulate the photo emission from the photocathode 106 with an efficiency that is maximized at the low wavelength end (255 nm) at roughly one part in $10^4$. The recent availability of short wavelength UV LEDs, extending to 240 nm and lower, can greatly improve photo-efficiency further. The advancement of UV LEDs makes possible the use of metal photocathodes stable to exposure to air, such as aluminum or copper, rather than the unstable high-efficiency bialkali photocathodes used in previous photo-electrically driven X-ray sources. The photo-efficiency of metal photocathodes does not change even after repeated exposure to air, which by contrast is known to poison other high-efficiency photocathodes, reducing their photo-efficiencies to well below $10^{-7}$ even for exposure to very low partial atmospheric pressures (e.g. $10^{-6}$ Torr).

However, the photo-efficiency of metal photocathodes is still insufficient for the purpose of producing practically useful X-ray output flux in many cases. The low efficiency of the metal photocathode 106 is offset by using a high-gain electron multiplier 110 that is configured to provide a gain of not less than $10^5$, but more typically $10^7$ or $10^8$, meaning that 100,000 to 100 million electrons are produced for every electron fed to the multiplier. Alternatively, a multichannel plate may be used instead of an electron multiplier.

The photocathode 106 may be vapor deposited onto the input cone (not shown in FIG. 1) of the electron multiplier 110. Electron multipliers with such quality are commercially available. Some of them are normally intended for use in portable mass spectrometers. Some of them are small, about 0.5-inch in diameter and about 1-inch in length, and easy to use. Thus this embodiment can be fabricated with weight as little as 230 grams for the whole device excluding the LED. It is also much smaller and about one percent of the cost to produce when compared to traditional photo-electrically driven devices. This embodiment thus yields an extremely robust, high intensity, compact and inexpensive photo-electrically driven electron source that can tolerate weeks or longer of exposure to air with negligible degradation.

In various embodiments, rapid assembly of the combined photocathode 106 and electron multiplier 110 into the vacuum tube 130 is highly desirable. For example, magnesium (Mg) is a desirable photocathode for some applications, but the longer it is exposed to air the more it corrodes, reducing photo-efficiency. In some embodiments, Mg or other photocathode materials may be sputtered directly onto the input end of the multiplier immediately prior to assembly.

An additional advantage of the use of an electron multiplier is that it prevents ions produced at the anode as a result of electron impact from flowing back toward the photocathode and generating unwanted photoelectric emission not directly related to modulation of the UV light source.

Those skilled in the art will appreciate that all components in FIG. 1 can be repositioned to achieve equivalent aforementioned functionalities. For example, the UV LED 102 may be repositioned inside the tube 130. Moreover, functionalities of different components in FIG. 1 may be functionally combined into a single component. For example, functionalities of the photocathode 106 and the electron multiplier 110 may be combined into a multiplier surface coated with a photocathode material. As another example, functionalities of the pump-out tube 126 and the getter 128 may be combined into a special getter with capacity to create the initial vacuum in the tube 130.

Figure 2:
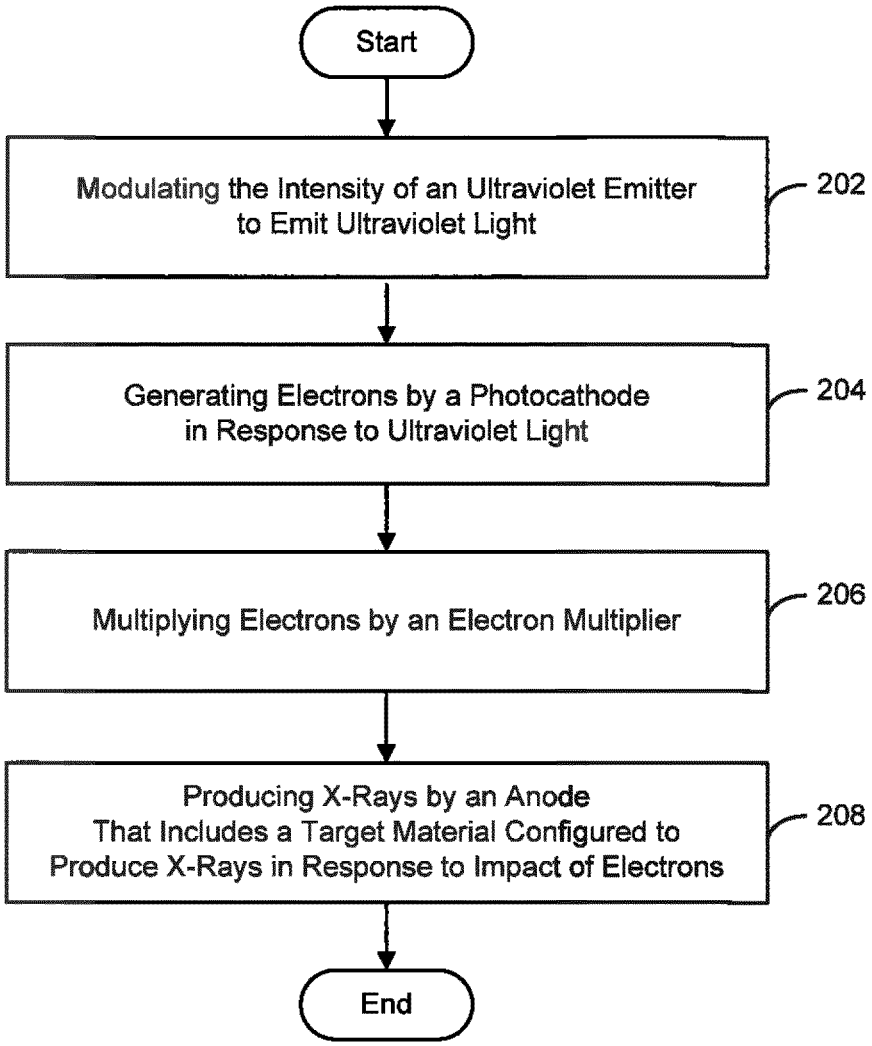
FIG. 2 is a flowchart generally representing the steps undertaken for modulating the X-ray output of a MXS incorporating aspects of the present disclosure.

Now turning to FIG. 2, there is a flowchart generally representing the steps undertaken for modulating the X-ray output of a MXS incorporating aspects of the present disclosure. As indicated at process block 202, one step is modulating the intensity of an ultraviolet emitter to emit ultraviolet light. For example, the intensity of the UV LED 102 can be modulated by modulating the drive current of the UV LED 102, thus modulating the UV LED from completely off to full intensity over arbitrary timescales down to nanosecond transitions. Another step is generating electrons by a photocathode in response to ultraviolet light indicated at process block 204. For example, the photocathode 106 may generate electrons by means of the photoelectric effect upon being excited by short-wavelength photons emitted by the UV LED 102. Yet another step is multiplying electrons by an electron multiplier as indicated at process block 206. For example, the high-gain electron multiplier 110, which is configured to provide a gain of not less than $10^5$, may multiply electrons through a process called secondary emission. The electron multiplier 110 may be powered through a multiplier high voltage (HV) feedthrough 112 with a negative bias voltage.

Yet another step is producing X-rays by an anode that includes a target material configured to produce X-rays in response to impact of electrons as indicated at process block 208. For example, the anode 118 includes a target material, such as tungsten, titanium, or copper. The multiplied electrons 116, after colliding with the target material, will accelerate other electrons, ions, and nuclei within the target material. A portion of the energy generated is emitted as X-rays 122. The output intensity of X-rays 122 is adjustable from zero to a maximum determined by the beam current in response to the modulation of the intensity of the ultraviolet emitter from zero to full intensity. For example, an UV LED can be modulated in intensity from completely off to full intensity over arbitrary timescales such as over sub-nanosecond transitions, thus causing the intensity of X-rays produced by the anode to be adjustable on identical timescales. The anode 118 may be powered through a target HV feedthrough 120 with a positive voltage sufficiently high to produce X-ray output of the desired maximum energy.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An X-ray source device, comprising:

an ultraviolet emitter that emits ultraviolet light;

a photocathode, operably coupled to the ultraviolet emitter, that emits electrons;

an electron multiplier, operably coupled the photocathode, that multiplies incident electrons; and an anode, operably coupled to the electron multiplier, that is configured to produce X-rays.

2. The device in accordance with claim 1, wherein the ultraviolet emitter is an ultraviolet light-emitting diode.

3. The device in accordance with claim 1, wherein the ultraviolet emitter is configured to be arbitrarily modulated in intensity between zero and full intensity over arbitrary timescales.

4. The device in accordance with claim 1, wherein the photocathode is a metal photocathode.

5. The device in accordance with claim 1, wherein the electron multiplier is configured to provide a gain of not less than $10^5$.

6. The device in accordance with claim 1, wherein an energy range of X-rays produced by the anode is adjustable up to at least 100 keV.

7. The device in accordance with claim 1, the device further comprising a vacuum tube that houses the photocathode, the electron multiplier, and the anode.

8. The device in accordance with claim 7, further comprising a pump-out tube operably coupled to the vacuum tube that is configured to be pinched off to seal vacuum inside the vacuum tube.

9. The device in accordance with claim 7, further comprising a getter operably coupled to the evacuated tube that is configured to maintain vacuum inside the vacuum tube.

10. The device in accordance with claim 7, further comprising an input window operably coupled to the vacuum tube that is configured to allow ultraviolet light to transmit into the vacuum tube.

11. The device in accordance with claim 10, wherein the input window is a quartz window.

12. The device in accordance with claim 7, further comprising an output window operably coupled to the vacuum tube that is configured to allow X-rays to transmit out the vacuum tube.

13. The device in accordance with claim 12, wherein the output window is a beryllium window.

14. A method of modulating an X-ray source, comprising:

modulating an intensity of an ultraviolet emitter to emit ultraviolet light onto a photocathode;

generating electrons in response to the ultraviolet light;

multiplying the electrons to become more electrons; and producing X-rays by an anode that includes a target material configured to produce X-rays in response to impact of the more electrons.

15. The method of claim 14, wherein the ultraviolet emitter is an ultraviolet light-emitting diode.

16. The method of claim 14, wherein the ultraviolet emitter is configured to be arbitrarily modulated in intensity between zero and full intensity on arbitrary timescales.

17. The method of claim 14, wherein modulating an intensity of an ultraviolet emitter comprises modulating a drive current to the ultraviolet emitter.

18. The method of claim 14, wherein multiplying the electrons comprises using an electron multiplier.

19. The method of claim 18, wherein the electron multiplier is configured to provide a gain of not less than $10^5$.

20. The method of claim 14, wherein multiplying the electrons comprises using a multichannel plate.

21. The method of claim 14, wherein the intensity of X-rays produced by the anode is arbitrarily adjustable between zero and a maximum intensity over arbitrary timescales in response to a change of the intensity of the ultraviolet emitter.

* * * * *